US010136239B1

(12) United States Patent
Stefanakis et al.

(10) Patent No.: US 10,136,239 B1
(45) Date of Patent: Nov. 20, 2018

(54) CAPTURING AND REPRODUCING SPATIAL SOUND APPARATUSES, METHODS, AND SYSTEMS

(71) Applicant: Foundation for Research and Technology—Hellas (FORTH), Heraklion, Crete (GR)

(72) Inventors: Nikolaos Stefanakis, Heraklion (GR); Athanasios Mouchtaris, Heraklion (GR)

(73) Assignee: FOUNDATION FOR RESEARCH AND TECHNOLOGY—HELLAS (F.O.R.T.H.), Heraklion (GR)

( * ) Notice: Subject to any disclaimer, the term of this patent is extended or adjusted under 35 U.S.C. 154(b) by 45 days.

(21) Appl. No.: 15/183,554

(22) Filed: Jun. 15, 2016

Related U.S. Application Data

(63) Continuation of application No. 15/001,211, filed on Jan. 19, 2016, now abandoned, and a (Continued)

(51) Int. Cl.
*H04S 7/00* (2006.01)

(52) U.S. Cl.
CPC ..... *H04S 7/301* (2013.01); *H04S 7/307* (2013.01); *H04S 2400/09* (2013.01); *H04S 2400/15* (2013.01); *H04S 2420/03* (2013.01)

(58) Field of Classification Search
CPC ..... H04S 7/301; H04S 7/307; H04S 2400/09; H04S 2400/15; H04S 2420/03
See application file for complete search history.

(56) References Cited

U.S. PATENT DOCUMENTS 7,555,161 B2 6/2009 Haddon et al.
7,826,623 B2 11/2010 Christoph
(Continued)

OTHER PUBLICATIONS

H. K. Maganti, D. Gatica-Perez, I. McCowan, "Speech Enhancement and Recognition in Meetings with an Audio-Visual Sensor Array," IEEE Transactions on Audio, Speech, and Language Processing, vol. 15, No. 8, Nov. 2007.
(Continued)

*Primary Examiner* — Regina N Holder
(74) *Attorney, Agent, or Firm* — Norton Rose Fulbright US LLP

(57) ABSTRACT

A processor-implemented method for capturing and reproducing spatial sound. The method includes: capturing a plurality of input signals using a plurality of sensors within a sound field; subjecting each input signal to a short-time Fourier transform to transform each signal into a transformed signal in the time-frequency domain; decomposing each of the transformed signals into a directional component and a diffuse component; optimizing beamformer weights using vector based amplitude panning to determine an optimal directivity pattern for the diffuse component of each transformed signal; constructing a set of diffuse sound channels using the diffuse components of the transformed signals and the optimized beamformer weights; constructing a set of directional sound channels using the directional components of the transformed signals; and reproducing the sound field by distributing the directional and diffuse sound channels to a plurality of output devices.

20 Claims, 6 Drawing Sheets

Related U.S. Application Data continuation-in-part of application No. 14/556,038, filed on Nov. 28, 2014, now Pat. No. 9,549,253, which is a continuation-in-part of application No. 14/294,095, filed on Jun. 2, 2014, which is a continuation-in-part of application No. 14/038,726, filed on Sep. 26, 2013, now Pat. No. 9,554,203.

(60) Provisional application No. 62/104,605, filed on Jan. 16, 2015, provisional application No. 61/909,882, filed on Nov. 27, 2013, provisional application No. 61/829,760, filed on May 31, 2013, provisional application No. 61/706,073, filed on Sep. 26, 2012.

(56) References Cited

U.S. PATENT DOCUMENTS

| | | | | |
|---|---|---|---|---|
| 8,073,287 | B1 * | 12/2011 | Wechsler | G06K 9/00281 359/306 |
| 8,923,529 | B2 | 12/2014 | McCowan | |
| 2008/0089531 | A1 | 4/2008 | Koga et al. | |
| 2009/0080666 | A1 | 3/2009 | Uhle et al. | |
| 2010/0135511 | A1 | 6/2010 | Pontoppidan | |
| 2010/0142327 | A1 | 6/2010 | Kepesi et al. | |
| 2010/0217590 | A1 | 8/2010 | Nemer et al. | |
| 2010/0278357 | A1 | 11/2010 | Hiroe | |
| 2011/0033063 | A1 | 2/2011 | McGrath et al. | |
| 2011/0091055 | A1 | 4/2011 | LeBlanc | |
| 2011/0110531 | A1 | 5/2011 | Klefenz et al. | |
| 2012/0020485 | A1 | 1/2012 | Visser et al. | |
| 2012/0051548 | A1 | 3/2012 | Visser et al. | |
| 2012/0114126 | A1 | 5/2012 | Thiergart et al. | |
| 2012/0140947 | A1 | 6/2012 | Shin | |
| 2012/0221131 | A1 | 8/2012 | Wang et al. | |
| 2013/0108066 | A1 | 5/2013 | Hyun et al. | |
| 2013/0142343 | A1 | 6/2013 | Matsui et al. | |
| 2013/0216047 | A1 | 8/2013 | Kuech et al. | |
| 2013/0259243 | A1 | 10/2013 | Herre et al. | |
| 2013/0268280 | A1 | 10/2013 | Del Galdo et al. | |
| 2013/0272548 | A1 | 10/2013 | Visser et al. | |
| 2013/0287225 | A1 | 10/2013 | Niwa et al. | |
| 2014/0025374 | A1 | 1/2014 | Lou | |
| 2014/0172435 | A1 | 6/2014 | Thiergart et al. | |
| 2014/0376728 | A1 | 12/2014 | Rämö et al. | |
| 2015/0310857 | A1 | 10/2015 | Habets et al. | |

OTHER PUBLICATIONS

B. Loesch et al., "Multidimensional localization of multiple sound sources using frequency domain ICA and an extended state coherence transform," *IEEE/SP 15th Workshop Statistical Signal Processing* (*SSP*), pp. 677-680, Sep. 2009.

A. Lombard et al., "TDOA estimation for multiple sound sources in noisy and reverberant environments using broadband independent component analysis," *IEEE Transactions on Audio, Speech, and Language Processing*, pp. 1490-1503, vol. 19, No. 6, Aug. 2011.

H. Sawada et al., "Multiple source localization using independent component analysis," *IEEE Antennas and Propagation Society International Symposium*, pp. 81-84, vol. 4B, Jul. 2005.

F. Nesta and M. Omologo, "Generalized state coherence transform for multidimensional TDOA estimation of multiple sources," *IEEE Transactions on Audio, Speech, and Language Processing*, pp. 246-260, vol. 20, No. 1 , Jan. 2012.

M. Swartling et al., "Source localization for multiple speech sources using low complexity non-parametric source separation and clustering," in *Signal Processing*, pp. 1781-1788, vol. 91, Issue 8, Aug. 2011.

C. Blandin et al., "Multi-source TDOA estimation in reverberant audio using angular spectra and clustering," in *Signal Processing*, vol. 92, No. 8, pp. 1950-1960, Aug. 2012.

D. Pavlidi et al., "Real-time multiple sound source localization using a circular microphone array based on single-source confidence measures," in *International Conference on Acoustics, Speech and Signal Processing* (*ICASSP*), pp. 2625-2628, Mar. 2012.

O. Yilmaz and S. Rickard, "Blind separation of speech mixtures via time-frequency masking," *IEEE Transactions on Audio, Speech, and Language Processing*, pp. 1830-1847, vol. 52, No. 7, Jul. 2004.

E. Fishler et al., "Detection of signals by information theoretic criteria: General asymptotic performance analysis," in *IEEE Transactions on Signal Processing*, pp. 1027-1036, vol. 50, No. 5, May 2002.

M. Puigt and Y. Deville, "A new time-frequency correlation-based source separation method for attenuated and time shifted mixtures," in *8th International Workshop on Electronics, Control, Modelling, Measurement and Signals 2007 and Doctoral School* (*EDSYS,GEET*), pp. 34-39, May 28-30, 2007.

G. Hamerly and C. Elkan, "Learning the k in k-means," in *Neural Information Processing Systems*, Cambridge, MA, USA: MIT Press, pp. 281-288, 2003.

B. Loesch and B. Yang, "Source number estimation and clustering for underdetermined blind source separation," in *Proceedings International Workshop Acoustic Echo Noise Control* (*IWAENC*), 2008.

S. Araki et al., "Stereo source separation and source counting with MAP estimation with dirichlet prior considering spatial aliasing problem," in *Independent Component Analysis and Signal Separation, Lecture Notes in Computer Science*. Berlin/Heidelberg, Germany: Springer , vol. 5441, pp. 742-750, 2009.

A. Karbasi and A. Sugiyama, "A new DOA estimation method using a circular microphone array," in *Proceedings European Signal Processing Conference* (*EUSIPCO*), 2007, pp. 778-782.

S. Mallat and Z. Zhang, "Matching pursuit with time-frequency dictionaries," *IEEE Transactions on Signal Processing*, vol. 41, No. 12, pp. 3397-3415, Dec. 1993.

D. Pavlidi et al., "Source counting in real-time sound source localization using a circular microphone array," in *Proc. IEEE 7th Sensor Array Multichannel Signal Process. Workshop* (*SAM*), Jun. 2012, pp. 521-524.

A. Griffin et al., "Real-time multiple speaker DOA estimation in a circular microphone array based on matching pursuit," in *Proceedings 20th European Signal Processing Conference* (*EUSIPCO*), Aug. 2012, pp. 2303-2307.

P. Comon and C. Jutten, Handbook of Blind Source Separation: Independent Component Analysis and Applications, ser. Academic Press. Burlington, MA: Elsevier, 2010.

M. Cobos et al., "On the use of small microphone arrays for wave field synthesis auralization," *Proceedings of the 45th International Conference: Applications of Time-Frequency Processing in Audio Engineering Society Conference*, Mar. 2012.

H. Hacihabiboglu and Z. Cvetkovic, "Panoramic recording and reproduction of multichannel audio using a circular microphone array," in *Proceedings of the IEEE Workshop on Applications of Signal Processing to Audio and Acoustics* (*WASPAA 2009*), pp. 117-120, Oct. 2009.

K. Niwa A. et al., "Encoding large array signals into a 3D sound field representation for selective listening point audio based on blind source separation," in *Proceedings of the IEEE International Conference on Acoustics, Speech and Signal Processing* (*ICASSP 2008*), pp. 181-184, Apr. 2008.

V. Pulkki, "Spatial sound reproduction with directional audio coding," *Journal of the Audio Engineering Society*, vol. 55, No. 6, pp. 503-516, Jun. 2007.

F. Kuech et al., "Directional audio coding using planar microphone arrays," in Proceedings of the Hands-free Speech Communication and Microphone Arrays (HSCMA), pp. 37-40, May 2008.

O. Thiergart et al., "Parametric spatial sound processing using linear microphone arrays," in *Proceedings of Microelectronic Systems*, A. Heuberger, G. Elst, and R.Hanke, Eds., pp. 321-329, Springer, Berlin, Germany, 2011.

M. Kallinger et al., "Enhanced direction estimation using microphone arrays for directional audio coding," in *Proceedings of the Hands-free Speech Communication and Microphone Arrays* (*HSCMA*), pp. 45-48, May 2008.

(56) References Cited

OTHER PUBLICATIONS

M. Cobos et al., "A sparsity-based approach to 3D binaural sound synthesis using time-frequency array processing," *Eurasip Journal on Advances in Signal Processing*, vol. 2010, Article ID 415840, 2010.
L.M. Kaplan et al., "Bearings-only target localization for an acoustical unattended ground sensor network," *Proceedings of Society of Photo-Optical Instrumentation Engineers* (*SPIE*), vol. 4393, pp. 40-51, 2001.
A. Bishop and P. Pathirana, "Localization of emitters via the intersection of bearing lines: A ghost elimination approach," *IEEE Transactions on Vehicular Technology*, vol. 56, No. 5, pp. 3106-3110, Sep. 2007.
A. Bishop and P. Pathirana, "A discussion on passive location discovery in emitter networks using angle-only measurements," *International Conference on Wireless Communications and Mobile Computing* (*IWCMC*), ACM, pp. 1337-1343, Jul. 2006.
J. Reed et al., "Multiple-source localization using line-of-bearing measurements: Approaches to the data association problem," *IEEE Military Communications Conference* (*MILCOM*), pp. 1-7, Nov. 2008.
A. Alexandridis et al., "Directional coding of audio using a circular microphone array," *IEEE International Conference on Acoustics, Speech and Signal Processing* (*ICASSP*), pp. 296-300, May 2013.
A. Alexandridis et al., "Capturing and Reproducing Spatial Audio Based on a Circular Microphone Array," *Journal of Electrical and Computer Engineering*, vol. 2013, Article ID 718574, pp. 1-16, 2013.
M. Taseska and E. Habets, "Spotforming using distributed microphone arrays," *IEEE Workshop on Applications of Signal Processing to Audio and Acoustics*, Oct. 2013.
S. Rickard and O. Yilmaz, "On the approximate w-disjoint orthogonality of speech," in *Proc. Of ICASSP*, 2002, vol. 1, pp. 529-532.
N. Ito et al., "Designing the wiener post-filter for diffuse noise suppression using imaginary parts of inter-channel cross-spectra," in *Proc. Of ICASSP*, 2010, pp. 2818-2821.
D. Pavlidi et al., "Real-time sound source localization and counting using a circular microphone array," *IEEE Trans. on Audio Speech, and Lang. Process*, vol. 21, No. 10, pp. 2193-2206, 2013.
L. Parra and C. Alvino, "Geometric source separation: merging convolutive source separation with geometric beamforming," *IEEE Transactions on Speech and Audio Processing*, vol. 10, No. 6, pp. 352-362, 2002.
V. Pulkki, "Virtual sound source positioning using vector based amplitude panning," *J. Audio Eng. Soc.*, vol. 45, No. 6, pp. 456-466, 1997.
J. Usher and J. Benesty, "Enhancement of spatial sound quality: A new reverberation-extraction audio upmixer," *IEEE Trans. on Audio Speech, and Lang. Process*, vol. 15, No. 7, pp. 2141-2150, 2007.
C. Faller and F. Baumgarte, "Binaural cue coding-part ii: Schemes and application," *IEEE Trans. on Speech and Audio Process*, vol. 11, No. 6, pp. 520-531, 2003.
M. Briand, et al., "Parametric representation of multichannel audio based on principal component analysis," in *AES 120th Conv.*, 2006.
M. Goodwin and J. Jot., "Primary-ambient signal decomposition and vector-based localization for spatial audio codding and enhancement," in *Proc. Of ICASSP*, 2007, vol. 1, pp. 1-9.
J. He et al., "A study on the frequency-domain primary-ambient extraction for stereo audio signals," in *Proc. Of ICASSP*, 2014, pp. 2892-2896.
J. He et al., "Linear estimation based primary-ambient extraction for stereo audio signals," *IEEE Trans. on Audio, Speech and Lang. Process.*, vol. 22, pp. 505-517, 2014.
C. Avendano and J. Jot, "A frequency domain approach to multichannel upmix," *J. Audio Eng. Soc*, vol. 52, No. 7/8, pp. 740-749, 2004.
O. Thiergart et al. "Diffuseness estimation with high temporal resolution via spatial coherence between virtual first-order microphones," in *Applications of Signal Processing to Audio and Acoustics* (*WASPAA*), 2011, pp. 217-220.
G. Carter et al, "Estimation of the magnitude-squared coherence function via overlapped fast fourier transform processing," *IEEE Trans. on Audio and Electroacoustics*, vol. 21, No. 4, pp. 337-344, 1973.
I. Santamaria and J. Via, "Estimation of the magnitude squared coherence spectrum based on reduced-rank canonical coordinates," in *Proc. Of ICASSP*, 2007, vol. 3, pp. III-985.
D. Ramirez, J. Via and I. Santamaria, "A generalization of the magnitude squared coherence spectrum for more than two signals: definition, properties and estimation," in *Proc. Of ICASSP*, 2008, pp. 3769-3772.
B. Cron and C. Sherman, "Spatial-correlation functions for various noise models," *J. Acoust. Soc. Amer.*, vol. 34, pp. 1732-1736, 1962.
H. Cox et al., "Robust adaptive beamforming," *IEEE Trans. on Acoust., Speech and Signal Process.*, vol. 35, pp. 1365-1376, 1987.

* cited by examiner

CAPTURING AND REPRODUCING SPATIAL SOUND APPARATUSES, METHODS, AND SYSTEMS

CROSS-REFERENCE TO RELATED APPLICATIONS

This application is a continuation of U.S. patent application Ser. No. 15/001,211, filed Jan. 19, 2016, which in turn claims priority to U.S. Provisional Patent Application No. 62/104,605, filed Jan. 16, 2015. This application is also a continuation-in-part of U.S. patent application Ser. No. 14/556,038, filed Nov. 28, 2014 (claiming priority to U.S. Provisional Patent Application No. 61/909,882, filed Nov. 27, 2013); which is in turn a continuation-in-part of U.S. patent application Ser. No. 14/294,095, filed Jun. 2, 2014 (claiming priority to U.S. Provisional Patent Application No. 61/829,760 filed May 31, 2013); which is in turn a continuation-in-part of U.S. patent application Ser. No. 14/038,726 filed Sep. 26, 2013 (claiming priority to U.S. Provisional Patent Application No. 61/706,073 filed Sep. 26, 2012). This application is also related to U.S. patent application Ser. No. 15/001,190 and U.S. patent application Ser. No. 15/001,221, both of which were filed on Jan. 19, 2016. Each of the applications listed in this paragraph are expressly incorporated by reference herein in their entirety.

FIELD

The present subject matter is directed generally to apparatuses, methods, and systems for capturing and reproducing acoustic environments, and more particularly, to CAPTURING AND REPRODUCING SPATIAL SOUND APPARATUSES, METHODS, AND SYSTEMS (hereinafter Sound Field Reproducer).

BACKGROUND

There are many applications where capturing and reproducing a crowded chaotic acoustic environment is desirable. For example, one application may include capturing and broadcasting the response of a large crowd during an event, such as a concert or sporting event. There is a need for systems capable of capturing and transmitting the sound field to a television set or other receiving device of an end user with minimal delay. If the end user is equipped with a surround sound system, the user will then be able to experience the actual acoustic event from his or her home, as if the user were present among the spectators in the crowd at the event.

SUMMARY

A processor-implemented method for capturing and reproducing spatial sound is disclosed, including: capturing a plurality of input signals using a plurality of sensors within a sound field; subjecting each input signal to a short-time Fourier transform to transform each signal into a transformed signal in the time-frequency domain; decomposing each of the transformed signals into a directional component and a diffuse component; optimizing beamformer weights using vector based amplitude panning to determine an optimal directivity pattern for the diffuse component of each transformed signal; constructing a set of diffuse sound channels using the diffuse components of the transformed signals and the optimized beamformer weights; constructing a set of directional sound channels using the directional components of the transformed signals; and reproducing the sound field by distributing the directional and diffuse sound channels to a plurality of output devices.

A system for capturing and reproducing spatial sound is also disclosed. The system includes: a plurality of sensors configured to capture a plurality of input signals within a sound field; a processor interfacing with the plurality of sensors and configured to receive the plurality of input signals; an STFT module configured to apply a short-time Fourier transform to create a transformed signal in the time-frequency domain corresponding to each input signal; a parametric processing module configured to decompose each of the transformed signals into a directional component and a diffuse component; a VBAP optimizer configured to optimize beamformer weights using vector based amplitude panning to determine an optimal directivity pattern for the diffuse component of each transformed signal, a diffuse channel constructor configured to construct a set of diffuse sound channels using the diffuse components of the transformed signals and the optimized beamformer weights; a direction channel constructor, configured to construct a set of directional sound channels using the directional components of the transformed signals; and a plurality of output devices interfacing with the processor and configured to receive the directional and diffuse sound channels and reproduce the sound field.

A processor-readable tangible medium for capturing and reproducing spatial sound is also disclosed. The medium stores processor-issuable-and-generated instructions to: capture a plurality of input signals using a plurality of sensors within a sound field; apply a short-time Fourier transform to each input signal to transform each signal into a transformed signal in the time-frequency domain; decompose each of the transformed signals into a directional component and a diffuse component; optimize beamformer weights using vector based amplitude panning to determine an optimal directivity pattern for the diffuse component of each transformed signal; construct a set of diffuse sound channels using the diffuse components of the transformed signals and the optimized beamformer weights; construct a set of directional sound channels using the directional components of the transformed signals; and reproduce the sound field by distributing the directional and diffuse sound channels to a plurality of output devices.

BRIEF DESCRIPTION OF THE DRAWINGS

The accompanying drawings illustrate various non-limiting, example, inventive aspects of the Sound Field Reproducer.

DETAILED DESCRIPTION

Sound Field Reproducer

CAPTURING AND REPRODUCING SPATIAL SOUND APPARATUSES, METHODS, AND SYSTEMS (hereinafter Sound Field Reproducer) are disclosed in this specification, which describes a novel approach for capturing and producing spatial sound, including in crowded acoustic environments. The acoustic conditions in such environments are different than those found in a typical acoustic environment in the sense that there are an enormous number of sound sources. For example, at a concert, game, or other event, there may be thousands of spectators cheering and applauding simultaneously at different angles and distances with respect to a sensor array used for capturing the acoustic scene. In one exemplary embodiment, the Sound Field Reproducer may be configured to use techniques that efficiently deal with such environments using a planar circular array with any number of sensors, although any other suitable type and configuration of sensors may also be used. While any number and positioning of loudspeakers may be used at the reproduction stage, the applicability of the exemplary technique used by the Sound Field Reproducer will be illustrated with respect to the 5.1 surround sound system, given that this system is the most popular system for home use. Although this specification refers to loudspeakers, it should be understood that any suitable output or playback device could be used with the Sound Field Reproducer. For example, the Sound Field Reproducer may be configured to reproduce captured spatial sound using headphones as a playback device, for example, applying a head-related transfer function (HRTF).

Figure 1:
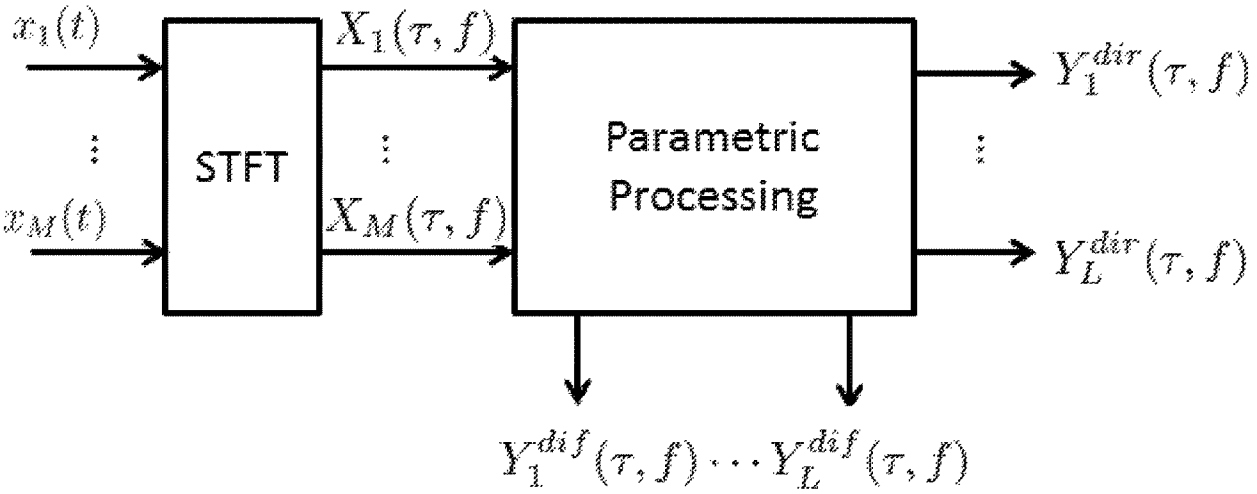
FIG. 1 shows an exemplary embodiment of the Sound Field Reproducer for capturing a sound field with M microphones and for reproducing the sound field with L loudspeakers.

FIG. 1 is a block diagram showing one exemplary method used by the Sound Field Reproducer. In this embodiment, the process is implemented in the time-frequency (TF) domain, which allows for very fine and flexible signal processing, as each time-frame index and each frequency bin can be treated individually. In one exemplary embodiment, the Sound Field Reproducer is configured to decompose the sound field into a directional and a diffuse component; this leads to the construction of a set of directional and diffuse sound channels which are then properly distributed to the available loudspeakers. The correct reproduction of the directional component requires the estimation of two parameters: the angular direction and the amplitude. The angular direction may be found by using a direction of arrival (DOA) estimation technique. Given the direction and amplitude of the directional component at each time-frequency point, the Sound Field Reproducer may use Vector Based Amplitude Panning (VBAP) for defining which loudspeakers and with which gain need to contribute in order to recreate the original sound field at the reproduction side. The Sound Field Reproducer may also use VBAP for designing the optimal directivity patterns for a set of beamformers configured to capture and transmit the diffuse sound field component in accordance with the number and placement of the available loudspeakers. By using this technique for finding optimal beamformer weights, the directional distribution of diffuse sound may be optimally preserved inside the reproduction room.

FIG. 1 illustrates an exemplary system used by the Sound Field Reproducer for capturing the sound field with M microphones and for reproducing the sound field using L loudspeakers. The short-time Fourier transform (STFT) is used for transforming the signal in the time-frequency domain, with $\tau$ symbolizing the time-frame index and f the frequency bin index. On the reproduction side, each loudspeaker emits the superposition of a directional signal $Y_l^{dir}(\tau, f)$ and a diffuse signal $Y_l^{dif}(\tau, f)$.

Vector Based Amplitude Panning (VBAP) is a technique that may be used by the Sound Field Reproducer when there is any given number of loudspeakers placed in arbitrary geometry around the listener. In one embodiment, the loudspeakers are nearly equidistant from the listener and the listening room is assumed to be not minimally reverberant.

VBAP is ideal for handling discrete point-like sources; it relies on simple amplitude panning for providing a mapping of the virtual source location onto the loudspeaker signals. Given the incident angle $\theta$ as an argument, the VBAP function is designed so that $$\mathrm{VBAP}(\theta)=[\mathrm{VBAP}_1(\theta), \ldots, \mathrm{VBAP}_L(\theta)]^T, \tag{1}$$

is the L×1 vector with the loudspeaker gains required for reproducing a plane wave sound field propagating at angle $\theta$ at the reproduction side. In one exemplary embodiment, the Sound Field Reproducer exploits this mapping (1) for finding the loudspeaker gains which are required for proper localization of the directional component of the sound field and (2) for designing desired directivity patterns for a set of fixed beamformers that are used to capture the diffuse sound field component. In one exemplary embodiment, the Sound Field Reproducer may be configured to exploit the use of VBAP for the design of beamformer directivity patterns. Indeed, assuming that the operation is limited on the azimuth plane, VBAP may dictate optimal directivity patterns with the following main characteristics: (1) the problem of cross-talk is efficiently addressed by ensuring that given an acoustic wave at any incident angle (in the azimuth plane), only two loudspeakers will be activated during reproduction; (2) it dictates a desired directivity pattern which is independent of frequency, (3) the angular response is equalized over all angles so that there is no information loss, and (4) the output of the beamformer corresponding to a particular directivity pattern can be sent directly to the corresponding loudspeaker without further processing.

Figure 2:
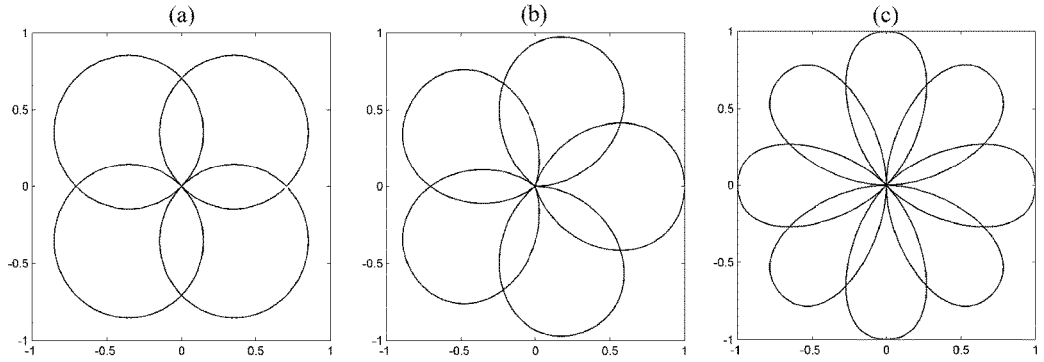
FIG. 2 shows directivity patterns for (a) a 4-channel system, (b) a 5-channel system and (c) an 8-channel system assuming uniformly distributed loudspeakers, as used in one embodiment of the Sound Field Reproducer.

FIG. 2 shows an example of how such directivity patterns would look when there are four, five, or eight loudspeakers (shown in (a), (b), and (c), respectively) assuming that the loudspeakers are distributed uniformly over all 360 degrees.

In one exemplary embodiment, the Sound Field Reproducer may be configured to optimize the beamformer weights for obtaining the directivity patterns dictated by VBAP. An exemplary optimization of the beamformer weights that may be used by the Sound Field Reproducer is described below.

For each loudspeaker with index l there is a corresponding directivity pattern $B_l(\theta)=\mathrm{VBAP}_l(\theta)$ which is defined according to VBAP as noted previously. Let $$w_l(f)=[w_{1l}(f), \ldots, w_{Ml}(f)]^T \tag{2}$$

be the vector with the beamformer weights mapped to the lth loudspeaker at each frequency f. The array response to a plane wave incident at an azimuth angle $\theta$ in the horizontal plane can be written as $$B_l(f,\theta)=w_l(f)^H d(f,\theta) \tag{3}$$

where d(f, θ) is the so-called steering vector $$d_m(f,\theta)=[d_1(f,\theta), \ldots, d_M(f,\theta)]^T, \tag{4}$$

with the complex transfer functions for each microphone given the plane wave incident angle θ.

Given a desired directivity pattern for the lth channel, the Sound Field Reproducer may find the optimal beamformer weights by minimizing the cost function $$J_l = \int_0^{2\pi} |B_l(\theta) - d(f, \theta)^H w_l(f)|^2 d\theta, \tag{5}$$

which describes the deviation between the reproduced and the desired beam pattern. To eliminate the integral, the Sound Field Reproducer may require that the reproduced beam pattern fits the desired pattern at N discrete angles, uniformly distributed along the circle at $\theta_n$, n=1, 2, . . . N. The above cost function can then be written in discretized form as $$J_l=\|B_l-D(f)^H w_l(f)\|_2^2. \tag{6}$$

Here, $B_l$ is the N×1 vector with the desired beamformer directivity and D(f)=[d(f, $\theta_1$), . . . , d(f, $\theta_N$)] is the M×N matrix with the transfer functions for each considered angle.

In one exemplary embodiment, the Sound Field Reproducer may determine the optimal beamformer weights by minimizing the least square fit between the desired complex directivity and the actual directivity at each frequency f, in which case the optimal beamformer weights at each frequency f may be derived as $$w_l^o(f)=(D(f)D(f)^H)^{-1}D(f)B. \tag{7}$$

Figure 3:
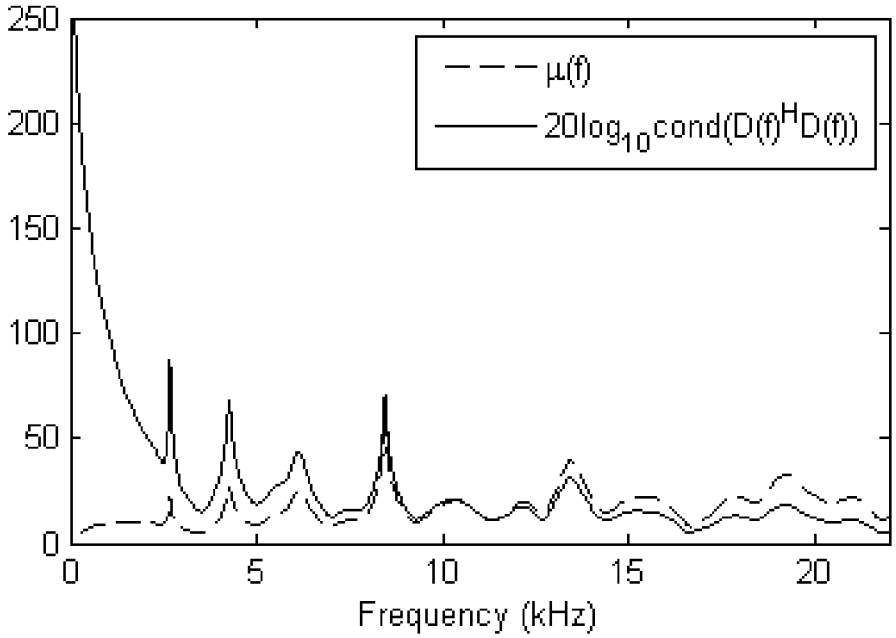
FIG. 3 shows a condition number of matrix $D(f)^H D(f)$ in dB (dotted line) and values of the regularization parameter $\mu$ (solid line) as a function of the frequency for an 8-sensor circular array of radius 5 cm, as used in one exemplary embodiment of the Sound Field Reproducer.

However, one issue with this approach is that matrix $D(f)D(f)^H$ becomes ill-conditioned at the lower frequencies as well as at other distinct frequencies and therefore its direct inversion leads to severe amplification of any noise which is present in the measurement. As an example, FIG. 3 is a plot of the condition number of matrix $D(f)D(f)^H$ for an eight-sensor circular array as a function of the frequency.

To avoid this issue, the Sound Field Reproducer may be configured to use a second technique for optimizing the beamformer weights, using Tikhonov regularization, i.e., by inserting a penalty term in the right hand side of the cost function of Eq. (6). The new cost function can be written as follows:

$$J_l=\|B-D(f)^H w_l(f)\|_2^2+\mu(f)w_l(f)^H w_l(f) \tag{8}$$

with μ(f) being the regularization parameter at frequency f and $w_l(f)^H w_l(f)$ representing the white-noise response.

One approach that may be used by the Sound Field Reproducer is to set the parameter at a constant value μ(f)=const, however its value may vary in order to better adapt to the ill-behavior at each frequency, so the Sound Field Reproducer may also be configured to use a dynamically varying value of μ:

$$\mu(f)=\lambda f 20 \log_{10}(\mathrm{cond}(D(f)D(f)^H)) \tag{9}$$

where λ is a fixed scalar and cond(•) represents the condition number of a matrix, e.g. the ratio of its largest eigenvalue to its smallest eigenvalue. An example of how the μ(f) varies as a function of frequency is shown in the solid line in FIG. 3.

The Sound Field Reproducer may now derive the beamformer weights through least squares minimization as follows:

$$w_l^o)(f)=(D(f)D(f)^H+\mu(f)I))^{-1}D(f)B. \tag{10}$$

where I is the M×M identity matrix.

In one exemplary embodiment, the Sound Field Reproducer may also be configured to use an additional normalization step, which aims to ensure unit gain and zero phase shift at the direction of maximum response for each beamformer. Letting $\theta_l^0$ denote this direction for the lth beam, the final weights may be calculated as $$\hat{w}_l^o(f) = \frac{w_l^o(f)}{w_l^o(f)^H d(f, \theta_l^0)}. \tag{11}$$

The actual lth beamformer directivity pattern can then be calculated according to the following equation:

$$\hat{B}_l(f,\theta)=\hat{w}_l^o(f)^H d(f,\theta). \tag{12}$$

Figure 4:
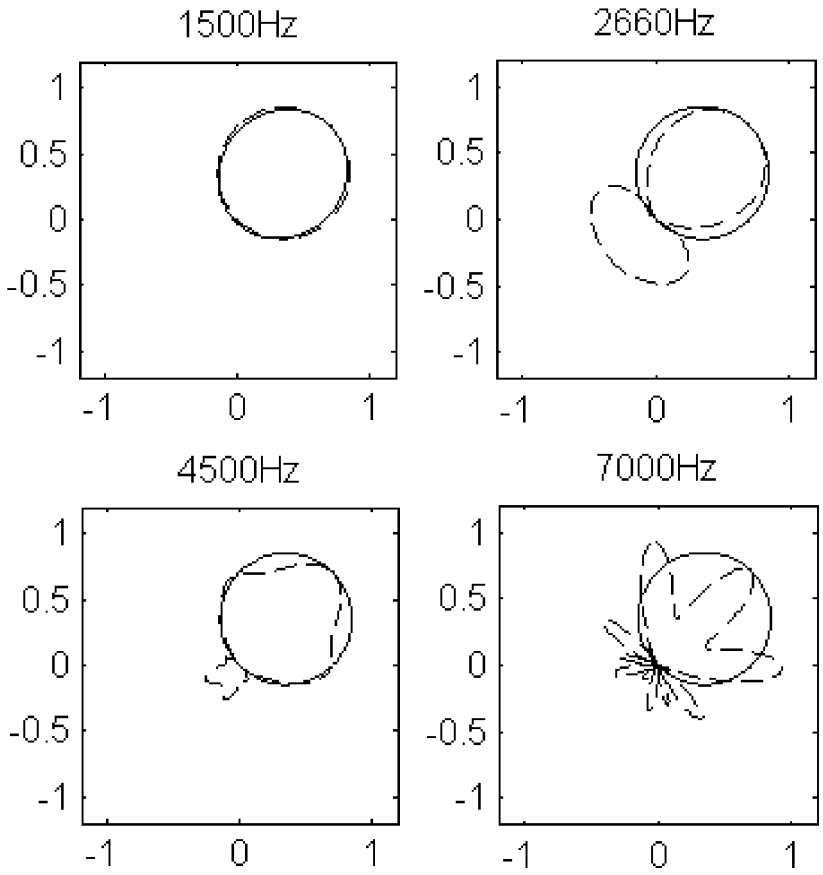
FIG. 4 shows directivity patterns (black) versus desired directivity patterns (gray) at different frequencies for an 8-element circular sensor array used in one exemplary embodiment of the Sound Field Reproducer.

FIG. 4 shows plots of the actual directivity versus the desired directivity pattern for an eight-element sensor array considering four uniformly distributed loudspeakers on the azimuth plane. The increment in the amplitude of the side-lobes at 2660 Hz, which is close to a problematic frequency according to FIG. 3, is clearly shown. Also, spatial aliasing is evident for frequencies above a certain frequency limit. Even when the actual beam patterns are severely different from the desired beam patterns, beamforming at these frequencies is still meaningful as it may still be used to de-correlate the loudspeaker signals. FIG. 4 shows actual directivity patterns versus desired directivity patterns at different frequencies for an eight-element circular sensor array. The directivity patterns are shown for the first loudspeaker at 45 degrees, considering a symmetric arrangement of four loudspeakers at angles of 45, 135, −135 and −45 degrees. As shown, the amplitude of the side-lobes at different frequencies scales with the condition number in FIG. 3.

In one exemplary embodiment, the Sound Field Reproducer may obtain the signal for the lth loudspeaker at frequency f and time instant τ using the following equation:

$$Y_l(\tau,f)=w_l(f)^H X(\tau,f). \tag{13}$$

In one embodiment, the lth signal may be transformed in the time domain using an inverse Fast Fourier Transform and played back by the corresponding loudspeaker without any further processing.

As shown in FIG. 4, it is difficult to obtain the exact desired beam-shapes relying on simple beamforming. Looking for example at subfigure 4(*c*), it is evident that a sound source at −135 degrees would be played back by the loudspeaker at 45 degrees, something that may severely deteriorate the spatial impression transmitted to the listener.

In one embodiment, the Sound Field Reproducer may be configured to alleviate the problems associated with the imperfect beamformer shapes by applying parametric spatial audio capturing and reproduction. For example, the Sound Field Reproducer may decompose the sound field into a directional and a diffuse component using a parametric processor. With respect to the directional component, the Sound Field Reproducer may perform DOA estimation in combination with VBAP in order to correctly reproduce the direction of localized sound sources. The Sound Field Reproducer may then treat the diffuse component separately, by applying beamforming with the beamformer weights which are derived as in the previous section. In this embodiment, the loudspeaker signal is calculated as the superposition of a directional and a diffuse sound, as shown below:

$$Y_l(\tau,f)=Y_l^{dir}(\tau,f)+Y_l^{dif}(\tau,f). \quad (14)$$

with $Y_l^{dir}(\tau, f)$ representing the directional and $Y_l^{dif}(\tau, f)$ the diffuse component. However, this method can be extended to compact microphone arrays comprised of an arbitrary number of sensors and in this way can provide a more flexible basis for sound field capturing and reproduction than other approaches. Furthermore, using the optimal beamformer weights produced by the Sound Field Reproducer, the directional distribution of diffuse sound is expected to be preserved.

Four exemplary approaches that may be used by the Sound Field Reproducer will be explained below: (1) dominant plane wave subtraction; (2) direct diffuse decomposition, (3) beamforming applied on the background component, and (4) DOA estimation and direct-to-diffuse decomposition based on imaginary parts of the inter-channel cross spectra.

In dominant plane wave subtraction, the Sound Field Reproducer assumes that at each frequency bin, the observed sound field $X(\tau, f)$ can be decomposed in terms of a dominant plane wave component propagating at an angle $\theta_{\tau,f}$, which needs to be estimated, and a residual component which can be treated as diffuse sound.

At each frequency bin, the Sound Field Reproducer performs a DOA estimation approach, for example, based on using a matched-filter beamformer for scanning all possible look-directions and then setting the DOA equal to the look-direction for which the beamformer obtains the maximum power output.

This beamforming process can be written in terms of the inner product between the observation signal $X(\tau, f)$ and all the steering vectors $d(f, \theta)$ calculated across a grid of N candidate angles spanning the entire space of interest. For example, to cover the entire azimuth plane, the candidate angle should span the entire range of [0, 360) degrees.

In particular, the DOA at frequency f and time-frame $\tau$ may be estimated as $$\theta_{\tau,f}=\mathrm{argmax}_{\theta} d(f,\theta)^H X(\tau,f) \quad (15)$$

Having found the DOA for the $(\tau, f)$ point, the Sound Field Reproducer may calculate the projection coefficient $c(\tau, f)$ as $$c(\tau,f)=d(f,\theta_{\tau,f})^H X(\tau,f)/M. \quad (16)$$

The directional and diffuse component in the observation signal can then be estimated as $$X^{dir}(\tau,f)=c(\tau,f)d(f,\theta_{\tau,f}) \quad (17)$$

$$X^{dif}(\tau,f)=X(\tau,f)-c(\tau,f)d(f,\theta_{\tau,f}). \quad (18)$$

In one embodiment, at each frequency, the projection coefficient $c(\tau, f)$ codes the amplitude and phase of the impinging plane wave while the angle is coded in terms of $\theta_{\tau,f}$. The input signal at the lth loudspeaker may be then defined as $Y_l(\tau, f)=Y_l^{dir}(\tau, f)+Y_l^{dif}(\tau, f)$ where $$Y_l^{dir}(\tau,f)=c(\tau,f)\mathrm{VBAP}(\theta_{\tau,f}), \quad (19)$$

$$Y_l^{dif}(\tau,f)=\hat{w}_l(f)^H X^{dif}(\tau,f). \quad (20)$$

Relying on the optimal beamformer weights $\hat{w}_l(f)$, the directional distribution of diffuse sound is expected to be preserved.

Direct to diffuse decomposition is another approach that may be used by the Sound Field Reproducer. The diffuseness of a sound field can be estimated with practical microphone setups based on the magnitude squared coherence (MSC), and several different approaches have been proposed for measuring MSC. The useful outcome of such an analysis is the estimation of the diffuseness coefficient $\Psi(\tau, f)$. Assuming that the directional and the diffuse component are mutually uncorrelated, the sound pressures $X(\tau, f)$ can be decomposed into a directional and a diffuse part as $$X^{dir}(\tau,f)=\sqrt{1-\Psi(\tau,f)}X(\tau,f) \quad (21)$$

$$X^{dif}(\tau,f)=\sqrt{\Psi(\tau,f)}X(\tau,f). \quad (22)$$

The procedure for defining the loudspeaker signals differs from the dominant plane wave subtraction approach in the way that the amplitude and phase of the directional and the diffuse component is defined. In particular, the dominant plane wave direction may be found by grid-search, but the amplitude and phase of the directional component is now set equal to the signal at a reference microphone (e.g. the first microphone), $X_{ref}^{dir}(f)$. The input signal at the lth loudspeaker may thus be defined as $Y_l(f)=Y_l^{dir}(f)+Y_l^{dif}(f)$ where $$Y_l^{dir}(f)=X_{ref}^{dir}(\tau,f)\mathrm{VBAP}(\theta_{\tau,f}), \quad (23)$$

$$Y_l^{dif}(f)=\hat{w}_l(f)^H X^{dif}(\tau,f). \quad (24)$$

The way that the directional and diffuse components are defined based on the diffuseness coefficient may not be optimal, because the two components have the same phase at each TF point and are inevitably correlated to one-another.

Beamforming applied on the background component is another approach that may be used by the Sound Field Reproducer to remove the foreground scene from the microphone signals. Assume that $X^{dif}(\tau, f)=[X_1^{dif}(\tau, f), \ldots, X_M^{dif}(\tau, f)]^T$ are the microphone signals at TF point $(\tau, f)$ containing only the background component. Then, the foreground component is completely ignored and the loudspeaker signals are derived using simple beamforming as $$Y_l(\tau,f)=\hat{w}_l(f)^H X^{dif}(\tau,f). \quad (25)$$

Direct-to-diffuse decomposition based on imaginary parts of the inter-channel cross-spectra is another method that may be used by the Sound Field Reproducer. This method provides a noise-robust solution to speech enhancement. The Sound Field Reproducer may be configured to exploit the this method in order to perform direct-to-diffuse sound field decomposition, while at the same time extending the method for the purpose of direction-of-arrival (DOA) estimation.

In one exemplary embodiment, the Sound Field Reproducer can produce an observation model for a sensor array comprised of M sensors embedded inside a diffuse noise field, while and at the same time receiving the signal from a single directional source. The observation model for sensor m can be written as follows:

$$X_m(\tau,f)=S(\tau,f)d_m(f)+U_m(\tau,f), \quad (26)$$

where $s(\tau, f)$ is the directional source signal, $d_m(f)=e^{-j2\pi f\delta_m}$ is the transfer function from the source to the sensor and $U_m(\tau, f)$ is the diffuse noise component which is assumed to be uncorrelated to the source signal.

The observation inter-channel cross spectrum between sensors m and n can thus be written $$\phi_{X_m X_n}(\tau, f) = E\{X_m(\tau, f)X_n^H(\tau, f)\}, \quad (27)$$

$$= \phi_{ss}(\tau, f)d_m(f)d_n^*(f) + \phi_{U_m U_n}(\tau, f), \quad (28)$$

where $\phi_{ss}$ is the source power spectrum and $\phi_{U_m U_n}$ represents the component of the cross-spectrum due to noise.

Assuming that the noise field is isotropic, then $\phi_{U_m U_n} \in \mathbb{R}$. This means that the imaginary part of the cross-spectra observation is immune to noise and therefore depends only on the directional source location.

Accordingly, the imaginary part of the complex number can be written as follows:

$$\Im\{\phi_{X_m X_n}(\tau,f)\}=\phi_{ss}(\tau,f)\sin(2\pi f(\delta_m-\delta_n)), \tag{29}$$

where $\Im\{\bullet\}$ denotes the imaginary part of a complex number. In one embodiment, the Sound Field Reproducer may use this observation to create a model of the imaginary cross-spectra terms through the following vector:

$$a(f,\theta)=[\sin(2\pi f(\delta_m(\theta)-\delta_n(\theta)))]_{m>n}\}, \tag{30}$$

which contains all the M(M−1)/2 pairwise sensor combinations, with delays $\delta_m(\theta)$ and $\delta_n(\theta)$ defined according to the incident plane wave angle θ. This vector can be seen as an alternative steering vector. Instead of coding the acoustic transfer path characteristics between the source and all microphone locations, it models the imaginary part of all the available cross-spectra terms, as a result of a plane wave incident on the array from angle θ. Also, this vector has the property $a(f, \theta\pm\pi)=-a(f, \theta)$, for θ in rad.

The Sound Field Reproducer may then construct a vector by the vertical concatenation of M(M−1)/2 imaginary observation cross-spectra terms, as follows:

$$z(\tau,f)=\Im\{[(\Phi_{mn}(\tau,f))]_{m>n}\}. \tag{31}$$

Vector $z(\tau, f)$ represents an immune-to-noise observation of the sound field which should be consistent with respect to the model in Eq. (30), given that the angle θ coincides with the actual source location. Given some direction-of-arrival (DOA) estimation techniques for the estimation of the instantaneous direction $\theta_{\tau,f}$, then the immune-to-noise observation $z(\tau, f)$ and the DOA specific plane wave signature $a(f, \theta_{\tau,f})$ can be used for estimating the ratio of the power of the directional component to the power of the diffuse component. This model additionally provides an exhaustive search solution for finding the unknown DOA at each TF point. In particular, the most likely DOA at frequency f and time-frame τ can be found by searching for the plane wave signature $a(f, \theta)$ which is most similar to $z(\tau, f)$, e.g.

$$\theta_{\tau,f}=\mathrm{argmax}_\theta(\hat{a}(f,\theta)^H z(\tau,f)). \tag{32}$$

where $\hat{a}(f, \theta)=a(f, \theta)/\|a(f, \theta)\|_2$ implies normalization with the Euclidean norm so that all plane wave signatures have the same energy.

Regardless of how the instantaneous direction is calculated, the Sound Field Reproducer can find the source power spectrum at a particular TF point by projecting $a(f, \theta_{\tau,f})$ onto $z(\tau, \omega)$ as $$\phi_{ss}(\tau, f) = \frac{a(f, \theta_{\tau,f})^H z(\tau, f)}{a(f, \theta_{\tau,f})^H a(f, \theta_{\tau,f})}. \tag{33}$$

On the other hand, the Sound Field Reproducer can estimate the total acoustic power by averaging the power across all microphones as $\phi_{yy}(\tau, f)=\mathrm{tr}(\Psi)/M$, where tr(•) is the sum of all the diagonal terms of a matrix. The ratio $g(\tau, f)=\phi_{ss}(\tau, f)/\phi_{yy}(\tau, f)$ then represents a useful metric which can be associated to the diffuseness of the sound field; $0\leq g(\tau, f)\leq 1$ should hold with a value close to 1 dictating a purely directional sound field whereas a value close to 0 a purely noisy sound field. Furthermore, the Sound Field Reproducer may use this metric to establish a relation with the so-called diffuseness of the sound field as $$\Psi(\tau,f)=\min\{0,1-g(\tau,f)\}, \tag{34}$$

where function min{•} returns the minimum of a set of number and is here useful in order to ensure that the diffuseness does not take negative values, in the case that $g(\tau, f)>1$.

The input signal at the lth loudspeaker may then be synthesized by the Sound Field Reproducer as $Y_l(\tau, f)=Y_l^{dir}(\tau, f)+Y_l^{dif}(f)$ where $$Y_l^{dir}(\tau,f)=X_{ref}(\tau,f)\sqrt{1-\Psi(\tau,f)}\,\mathrm{VBAP}(\theta_{\tau,f}), \tag{35}$$

$$Y_l^{dif}(\tau,f)=\hat{w}_l(f)^H\sqrt{\Psi(\tau,f)}X(\tau,f). \tag{36}$$

In this embodiment, the $X_{ref}(\tau, f)$ is the captured signal at a reference microphone (i.e. the first microphone) and $\hat{w}_l(f)$ are the beamformer weights derived previously. Relying on the optimal beamformer directivity patterns explained previously, the directional distribution of diffuse sound is expected to be preserved.

The 5.1 surround sound system is one of the most popular configuration for spatial sound reproduction. In one exemplary embodiment, the Sound Field Reproducer may be optimized in terms of such a configuration. For example, the Sound Field Reproducer may be configured to use a 5.1 surround sound system consisting of five loudspeakers at the classical positions denoted as L, C, R, Ls, and Rs, corresponding to left, center, right, left-surround and right-surround. In one embodiment, the corresponding loudspeaker angles are assumed to be −45, 0, 45, −135 and 135 degrees.

Figure 5:
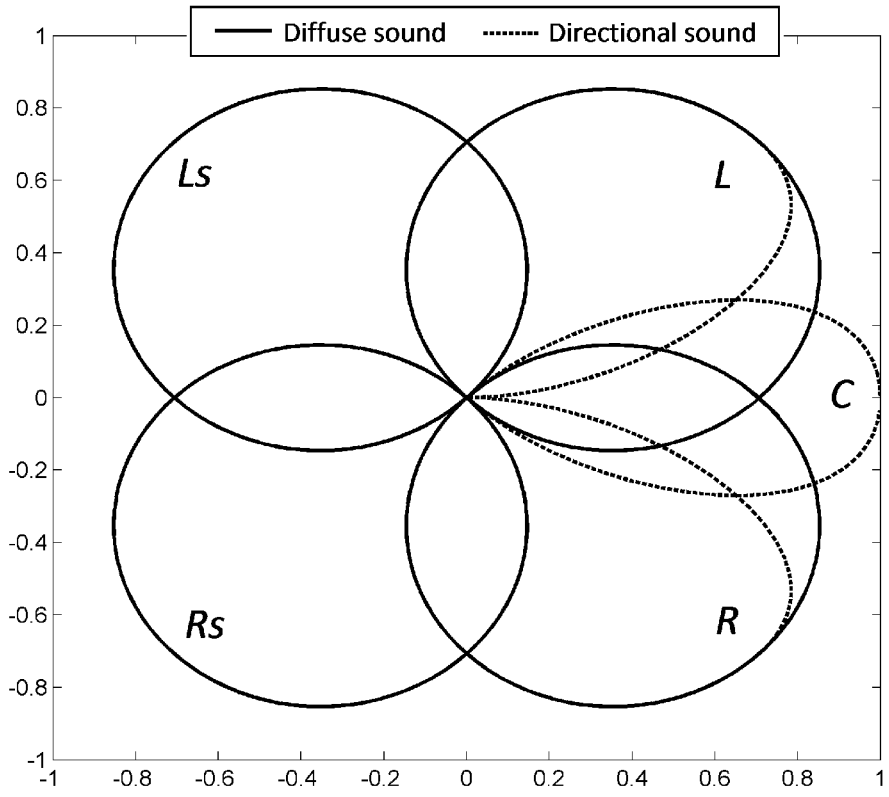
FIG. 5 shows directional sound (dotted line) and diffuse sound (solid line) beam patterns for a 5.1 surround sound system in one exemplary embodiment of the Sound Field Reproducer.

To fully exploit the angular coverage of the 5.1 surround sound system, the Sound Field Reproducer may be configured to use all five channels for transmitting directional information. In particular, all five channels may be used for the reproduction of the directional components, but the center channel (C) may be excluded during the reproduction of the diffuse components. The directivity patterns corresponding to directional and diffuse sound can be seen in FIG. 5. As shown, for the Ls and Rs channels, the directivity patterns for diffuse and directional sound are identical.

The method may be easily adapted to different loudspeaker arrangements since both the directional and the diffuse signal components are based on VBAP, which is flexible with respect to the loudspeaker arrangement. However, in one exemplary embodiment, there should be at least three loudspeakers and the maximum angular separation between two adjacent loudspeakers should not be greater than 180 degrees.

Use of the Sound Field Reproducer with a 5.1 surround sound system is given for exemplary purposes only. It should be understood that the Sound Field Reproducer could also be used with a 7.1 surround sound system or any other setup.

Sound Field Reproducer Controller

Figure 6:
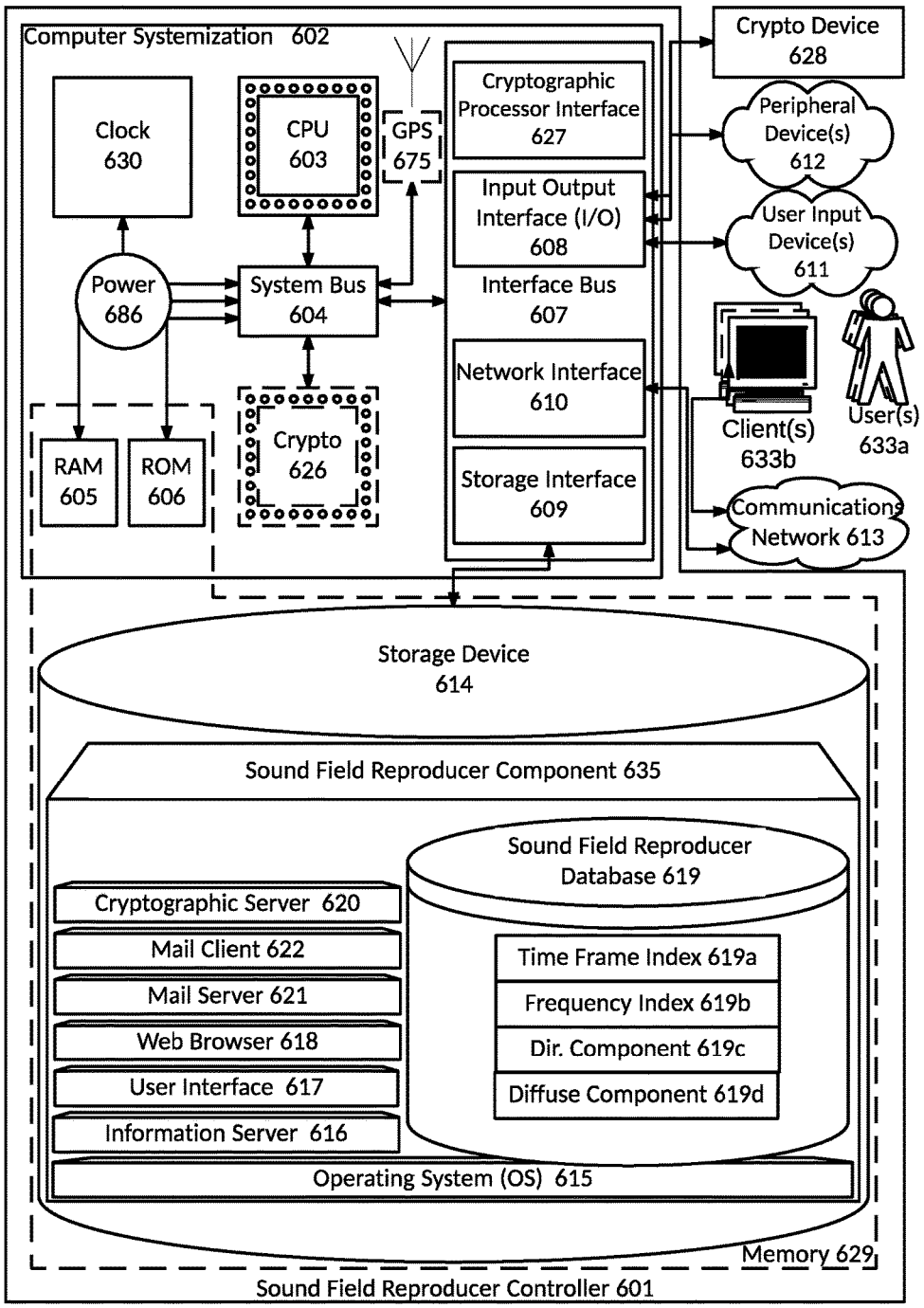
FIG. 6 is a block diagram illustrating exemplary embodiments of a Sound Field Reproducer controller.

FIG. 6 illustrates inventive aspects of an Sound Field Reproducer controller 601 in a block diagram. In this embodiment, the Sound Field Reproducer controller 601 may serve to provide real-time capturing and reproduction of crowded acoustic environments.

Typically, users, which may be people and/or other systems, may engage information technology systems (e.g., computers) to facilitate information processing. In turn, computers employ processors to process information; such processors 603 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 629 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the Sound Field Reproducer controller 601 may be connected to and/or communicate with entities such as, but not limited to: one or more users from user input devices 611; peripheral devices 612; an optional cryptographic processor device 628; and/or a communications network 613.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The Sound Field Reproducer controller 601 may be based on computer systems that may comprise, but are not limited to, components such as: a computer systemization 602 connected to memory 629.

Computer Systemization

A computer systemization 602 may comprise a clock 630, central processing unit ("CPU(s)" and/or "processor(s)" (these terms are used interchangeable throughout the disclosure unless noted to the contrary)) 603, a memory 629 (e.g., a read only memory (ROM) 606, a random access memory (RAM) 605, etc.), and/or an interface bus 607, and most frequently, although not necessarily, are all interconnected and/or communicating through a system bus 604 on one or more (mother)board(s) 602 having conductive and/or otherwise transportive circuit pathways through which instructions (e.g., binary encoded signals) may travel to effect communications, operations, storage, etc. Optionally, the computer systemization may be connected to an internal power source 686. Optionally, a cryptographic processor 626 may be connected to the system bus. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 629 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the Sound Field Reproducer controller and beyond through various interfaces. Should processing requirements dictate a greater amount speed and/or capacity, distributed processors (e.g., Distributed Sound Field Reproducer), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the Sound Field Reproducer may be achieved by implementing a microcontroller such as CAST's R8051XC2 microcontroller; Intel's MCS 51 (i.e., 8051 microcontroller); and/or the like. Also, to implement certain features of the Sound Field Reproducer, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the Sound Field Reproducer component collection (distributed or otherwise) and/or features may be implemented via the microprocessor and/or via embedded components; e.g., via ASIC, coprocessor, DSP, FPGA, and/or the like. Alternately, some implementations of the Sound Field Reproducer may be implemented with embedded components that are configured and used to achieve a variety of features or signal processing.

Depending on the particular implementation, the embedded components may include software solutions, hardware solutions, and/or some combination of both hardware/software solutions. For example, Sound Field Reproducer features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the Sound Field Reproducer features. A hierarchy of programmable interconnects allow logic blocks to be interconnected as needed by the Sound Field Reproducer system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the Sound Field Reproducer may be developed on regular FPGAs and then migrated into a fixed version that more resembles ASIC implementations. Alternate or coordinating implementations may migrate Sound Field Reproducer controller features to a final ASIC instead of or in addition to FPGAs. Depending on the implementation all of the aforementioned embedded components and microprocessors may be considered the "CPU" and/or "processor" for the Sound Field Reproducer.

Power Source

The power source 686 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 686 is connected to at least one of the interconnected subsequent components of the Sound Field Reproducer thereby providing an electric current to all subsequent components. In one example, the power source 686 is connected to the system bus component 604. In an alternative embodiment, an outside power source 686 is provided through a connection across the I/O 608 interface. For example, a USB and/or IEEE 1394 connection carries both data and power across the connection and is therefore a suitable source of power.

Interface Adapters

Interface bus(ses) 607 may accept, connect, and/or communicate to a number of interface adapters, conventionally although not necessarily in the form of adapter cards, such as but not limited to: input output interfaces (I/O) 608, storage interfaces 609, network interfaces 610, and/or the like. Optionally, cryptographic processor interfaces 627 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 609 may accept, communicate, and/or connect to a number of storage devices such as, but not limited to: storage devices 614, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 610 may accept, communicate, and/or connect to a communications network 613. Through a communications network 613, the Sound Field Reproducer controller is accessible through remote clients **633*b* (e.g., computers with web browsers) by users 633*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed Sound Field Reproducer), architectures may similarly be employed to pool, load balance, and/or otherwise increase the communicative bandwidth required by the Sound Field Reproducer controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 610 may be used to engage with various communications network types 613**. For example, multiple network interfaces may be employed to allow for the communication over broadcast, multicast, and/or unicast networks.

Input Output interfaces (I/O) 608 may accept, communicate, and/or connect to user input devices 611, peripheral devices 612, cryptographic processor devices 628, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless: 802.11a/b/g/n/x, Bluetooth, code division multiple access (CDMA), global system for mobile communications (GSM), WiMax, etc.; and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 611 may be card readers, dongles, finger print readers, gloves, graphics tablets, joysticks, keyboards, mouse (mice), remote controls, retina readers, trackballs, trackpads, and/or the like.

Peripheral devices 612 may be connected and/or communicate to I/O and/or other facilities of the like such as network interfaces, storage interfaces, and/or the like. Peripheral devices may be audio devices, cameras, dongles (e.g., for copy protection, ensuring secure transactions with a digital signature, and/or the like), external processors (for added functionality), goggles, microphones, monitors, network interfaces, printers, scanners, storage devices, video devices, video sources, visors, and/or the like.

It should be noted that although user input devices and peripheral devices may be employed, the Sound Field Reproducer controller may be embodied as an embedded, dedicated, and/or monitor-less (i.e., headless) device, wherein access would be provided over a network interface connection.

Cryptographic units such as, but not limited to, microcontrollers, processors 626, interfaces 627, and/or devices 628 may be attached, and/or communicate with the Sound Field Reproducer controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+ MB/s of cryptographic instructions; VLSI Technology's 33 MHz 6868; and/or the like.

Memory

Generally, any mechanization and/or embodiment allowing a processor to affect the storage and/or retrieval of information is regarded as memory 629. However, memory is a fungible technology and resource, thus, any number of memory embodiments may be employed in lieu of or in concert with one another. It is to be understood that the Sound Field Reproducer controller and/or a computer systemization may employ various forms of memory 629. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 629 will include ROM 606, RAM 605, and a storage device 614. A storage device 614 may be any conventional computer system storage. Storage devices may include a drum; a (fixed and/or removable) magnetic disk drive; a magneto-optical drive; an optical drive (i.e., Blu-eray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 629 may contain a collection of program and/or database components and/or data such as, but not limited to: operating system component(s) 615 (operating system); information server component(s) 616 (information server); user interface component(s) 617 (user interface); Web browser component(s) 618 (Web browser); Sound Field Reproducer database(s) 619; mail server component(s) 621; mail client component(s) 622; cryptographic server component(s) 620 (cryptographic server); the Sound Field Reproducer component(s) 635; and/or the like (i.e., collectively a component collection). These components may be stored and accessed from the storage devices and/or from storage devices accessible through an interface bus. Although non-conventional program components such as those in the component collection, typically, are stored in a local storage device 614, they may also be loaded and/or stored in memory such as: peripheral devices, RAM, remote storage facilities through a communications network, ROM, various forms of memory, and/or the like.

Operating System

The operating system component 615 is an executable program component facilitating the operation of the Sound Field Reproducer controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the Sound Field Reproducer controller to communicate with other entities through a communications network 613. Various communication protocols may be used by the Sound Field Reproducer controller as a subcarrier transport mechanism for interaction, such as, but not limited to: multicast, TCP/IP, UDP, unicast, and/or the like.

Information Server

An information server component 616 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the Sound Field Reproducer controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the Sound Field Reproducer database 619, operating systems, other program components, user interfaces, Web browsers, and/or the like.

Access to the Sound Field Reproducer database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the Sound Field Reproducer. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the Sound Field Reproducer as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 617 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 618 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the Sound Field Reproducer enabled nodes. The combined application may be nugatory on systems employing standard Web browsers.

Mail Server

A mail server component 621 is a stored program component that is executed by a CPU 603. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the Sound Field Reproducer.

Access to the Sound Field Reproducer mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component is a stored program component that is executed by a CPU 603. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component is a stored program component that is executed by a CPU 603, cryptographic processor 626, cryptographic processor interface 627, cryptographic processor device 628, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the Sound Field Reproducer may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the Sound Field Reproducer component to engage in secure transactions if so desired. The cryptographic component facilitates the secure accessing of resources on the Sound Field Reproducer and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The Sound Field Reproducer Database

The Sound Field Reproducer database component 619 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the Sound Field Reproducer database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the Sound Field Reproducer database is implemented as a data-structure, the use of the Sound Field Reproducer database 619 may be integrated into another component such as the Sound Field Reproducer component 635. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 619 includes several tables 619*a-e*, including a time_frame_index table 619*a*, a frequency_index table 619*b*, a directional_component table 619*c*, and a diffuse_component table 619*d*.

In one embodiment, the Sound Field Reproducer database may interact with other database systems. For example, employing a distributed database system, queries and data access by search Sound Field Reproducer component may treat the combination of the Sound Field Reproducer database, an integrated data security layer database as a single database entity.

In one embodiment, user programs may contain various user interface primitives, which may serve to update the Sound Field Reproducer. Also, various accounts may require custom database tables depending upon the environments and the types of clients the Sound Field Reproducer may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 619*a-d*. The Sound Field Reproducer may be configured to keep track of various settings, inputs, and parameters via database controllers.

The Sound Field Reproducer database may communicate to and/or with other components in a component collection, including itself, and/or facilities of the like. Most frequently, the Sound Field Reproducer database communicates with the Sound Field Reproducer component, other program components, and/or the like. The database may contain, retain, and provide information regarding other nodes and data.

The Sound Field Reproducers

The Sound Field Reproducer component 635 is a stored program component that is executed by a CPU. In one embodiment, the Sound Field Reproducer component incorporates any and/or all combinations of the aspects of the Sound Field Reproducer that was discussed in the previous figures. As such, the Sound Field Reproducer affects accessing, obtaining and the provision of information, services, transactions, and/or the like across various communications networks.

The Sound Field Reproducer component enables the determination of weights for constituents of index-linked financial portfolios, the acquisition and/or maintenance/management of those constituents, the determination of market values and/or returns associated with the indices, the generation of financial products based on the indices, and/or the like and use of the Sound Field Reproducer.

The Sound Field Reproducer component enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java;

JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the Sound Field Reproducer server employs a cryptographic server to encrypt and decrypt communications. The Sound Field Reproducer component may communicate to and/or with other components in a component collection, including itself, and/or facilities of the like. Most frequently, the Sound Field Reproducer component communicates with the Sound Field Reproducer database, operating systems, other program components, and/or the like. The Sound Field Reproducer may contain, communicate, generate, obtain, and/or provide program component, system, user, and/or data communications, requests, and/or responses.

Distributed Sound Field Reproducers

The structure and/or operation of any of the Sound Field Reproducer node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the Sound Field Reproducer controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), local and remote application program interfaces Jini, Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using standard development tools such as lex, yacc, XML, and/or the like, which allow for grammar generation and parsing functionality, which in turn may form the basis of communication messages within and between components. For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., the SOAP parser) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

To address various issues related to, and improve upon, previous work, the application is directed to CAPTURING AND REPRODUCING SPATIAL SOUND APPARATUSES, METHODS, AND SYSTEMS. The entirety of this application (including the Cover Page, Title, Headings, Field, Background, Summary, Brief Description of the Drawings, Detailed Description, Claims, Abstract, Figures, Appendices, and any other portion of the application) shows by way of illustration various embodiments. The advantages and features disclosed are representative; they are not exhaustive or exclusive. They are presented only to assist in understanding and teaching the claimed principles. It should be understood that they are not representative of all claimed inventions. As such, certain aspects of the invention have not been discussed herein. That alternate embodiments may not have been presented for a specific portion of the invention or that further undescribed alternate embodiments may be available for a portion of the invention is not a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope of the invention. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like. As such, it should be understood that advantages, embodiments, examples, functionality, features, logical aspects, organizational aspects, structural aspects, topological aspects, and other aspects of the disclosure are not to be considered limitations on the disclosure as defined by the claims or limitations on equivalents to the claims.

Depending on the particular needs and/or characteristics of an Sound Field Reproducer user, various embodiments of the Sound Field Reproducer may be implemented that enable a great deal of flexibility and customization. However, it is to be understood that the apparatuses, methods and systems discussed herein may be readily adapted and/or reconfigured for a wide variety of other applications and/or implementations. The exemplary embodiments discussed in this disclosure are not mutually exclusive and may be combined in any combination to implement the functions of the Sound Field Reproducer.

The invention claimed is:

1. A processor-implemented method for capturing and reproducing spatial sound, the method comprising:

capturing a plurality of input signals using a plurality of sensors within a sound field;

subjecting each input signal to a short-time Fourier transform to transform each signal into a transformed signal in the time-frequency domain;

decomposing each of the transformed signals into a directional component and a diffuse component;

optimizing beamformer weights using vector based amplitude panning to determine an optimal directivity pattern for the diffuse component of each transformed signal;

constructing a set of diffuse sound channels using the diffuse components of the transformed signals and the optimized beamformer weights; and constructing a set of directional sound channels using the directional components of the transformed signals;

reproducing the sound field by distributing the directional and diffuse sound channels to a plurality of output devices.

2. The method of claim 1, wherein decomposing each of the transformed signals into a directional component and a diffuse component comprises using dominant plane wave subtraction, where at each of a plurality of frequency bins produced by the short-time Fourier transform, the transformed signal is decomposed in terms of a dominant plane wave component propagating at an estimated angle, and a residual component is treated as diffuse sound.

3. The method of claim 1, wherein decomposing each of the transformed signals into a directional component and a diffuse component includes using direct-to-diffuse decomposition based on magnitude squared coherence.

4. The method of claim 1, wherein decomposing each of the transformed signals into a directional component and a diffuse component includes removing a foreground scene.

5. The method of claim 1, wherein decomposing each of the transformed signals into a directional component and a diffuse component includes using an imaginary part of a cross-spectra observation that is immune to noise and a direction-of-arrival specific plane wave signature to estimate the ratio of the power of the direction component to the power of the diffuse component.

6. The method of claim 1, wherein determining the directional component of the transformed signal includes determining an angular direction and an amplitude, wherein the angular direction is determined using a direction-of-arrival estimation technique.

7. The method of claim 1, wherein the optimal directivity pattern ensures that given an acoustic wave at any incident angle in an azimuth plane, only two loudspeakers will be activated during reproduction.

8. The method of claim 1, wherein the optimal directivity pattern is independent of frequency.

9. The method of claim 1, wherein the optimal directivity pattern is configured to equalize the angular response over all angles so that there is no to reduce information loss.

10. The method of claim 1, wherein optimizing beamformer weights comprises using Tikhonov regularization by multiplying the white-noise response by a regularization parameter.

11. A system for capturing and reproducing spatial sound, the system comprising:

a plurality of sensors configured to capture a plurality of input signals within a sound field;

a processor interfacing with the plurality of sensors and configured to receive the plurality of input signals;

an STFT module configured to apply a short-time Fourier transform to create a transformed signal in the time-frequency domain corresponding to each input signal;

a parametric processing module configured to decompose each of the transformed signals into a directional component and a diffuse component;

a VBAP optimizer configured to optimize beamformer weights using vector based amplitude panning to determine an optimal directivity pattern for the diffuse component of each transformed signal, construct a set of diffuse sound channels using the diffuse components of the transformed signals and the optimized beamformer weights; and a sound-channel constructor, configured to construct a set of directional sound channels using the directional components of the transformed signals; and a plurality of output devices interfacing with the processor and configured to receive the directional and diffuse sound channels and reproduce the sound field.

12. The system of claim 11, wherein the decomposition modules is configured to use dominant plane wave subtraction, where at each of a plurality of frequency bins produced by the short-time Fourier transform, the transformed signal is decomposed in terms of a dominant plane wave component propagating at an estimated angle, and a residual component is treated as diffuse sound.

13. The system of claim 11, wherein the decomposition module is configured to use direct-to-diffuse decomposition based on magnitude squared coherence.

14. The system of claim 11, wherein the decomposition module is configured to remove a foreground scene.

15. The system of claim 11, wherein the decomposition module is configured to determine an imaginary part of a cross-spectra observation that is immune to noise and a direction-of-arrival specific plane wave signature to estimate the ratio of the power of the direction component to the power of the diffuse component.

16. The system of claim 1, wherein the plurality of sensors comprises a planar circular array.

17. The system of claim 11, wherein the plurality of sensors comprises a plurality of microphones.

18. The system of claim 11, wherein the plurality of output devices comprises a plurality of loudspeakers.

19. The system of claim 11, wherein the output devices includes at least five loudspeakers, with a loudspeaker positioned in the left, center, right, left-surround, and right-surround position, wherein the system uses all five channels for the reproduction of the directional components but excludes the center channel during the reproduction of the diffuse components.

20. A non-transitory processor-readable medium for capturing and reproducing spatial sound, the medium storing processor-issuable-and-generated instructions to:

capture a plurality of input signals using a plurality of sensors within a sound field;

apply a short-time Fourier transform to each input signal to transform each signal into a transformed signal in the time-frequency domain;

decompose each of the transformed signals into a directional component and a diffuse component;

optimize beamformer weights using vector based amplitude panning to determine an optimal directivity pattern for the diffuse component of each transformed signal;

construct a set of diffuse sound channels using the diffuse components of the transformed signals and the optimized beamformer weights; and construct a set of directional sound channels using the directional components of the transformed signals; and reproduce the sound field by distributing the directional and diffuse sound channels to a plurality of output devices.

* * * * *